US007008361B1

(12) United States Patent
Levin et al.

(10) Patent No.: US 7,008,361 B1
(45) Date of Patent: Mar. 7, 2006

(54) TRAINING DEVICE ASSEMBLY FOR GROUP EXERCISES, GAMES AND TEAM CONTESTS

(76) Inventors: Moshe Levin, B.Mitudella St., 3, Jerusalem (IL) 92305; Julia Segal, Ha-Nurit St., 23 Apt. 6, Jerusalem (IL) 96510

( * ) Notice: Subject to any disclaimer, the term of this patent is extended or adjusted under 35 U.S.C. 154(b) by 0 days.

(21) Appl. No.: 09/979,397

(22) PCT Filed: May 23, 2000

(86) PCT No.: PCT/IL00/00291

§ 371 (c)(1),
(2), (4) Date: Nov. 23, 2001

(87) PCT Pub. No.: WO00/71219

PCT Pub. Date: Nov. 30, 2000

(30) Foreign Application Priority Data

May 24, 1999 (IL) ..... 130096

(51) Int. Cl.
*A63B 23/00* (2006.01)

(52) U.S. Cl. ..... 482/148; 482/121; 482/129; 472/1; D21/830

(58) Field of Classification Search ..... 482/122–148, 482/121; 472/1; D21/830, 662, 811, 814
See application file for complete search history.

(56) References Cited

U.S. PATENT DOCUMENTS

| | | | | | |
|---|---|---|---|---|---|
| 2,221,215 | A | * | 11/1940 | Eyerly | 472/50 |
| 3,767,194 | A | * | 10/1973 | Barber | 472/1 |
| 5,203,744 | A | * | 4/1993 | Checketts | 472/131 |
| 5,221,241 | A | * | 6/1993 | Bare, II | 482/43 |
| 5,421,783 | A | * | 6/1995 | Kockelman et al. | 472/135 |
| 5,649,866 | A | * | 7/1997 | Balwanz | 472/118 |
| 5,788,606 | A | * | 8/1998 | Rich | 482/27 |

* cited by examiner

*Primary Examiner*—Gregory L. Huson
*Assistant Examiner*—L. Amerson

(57) ABSTRACT

Body exercisers, usable in a plurality of modifications, encouraging exercising on sports training devices through users' emotional stimulation and intended for group exercising, games and team contests. Prior art training devices and/or any modifications of prior art training devices are used as components of a whole training device assembly, comprising: supporting resilient elements; supporting structure including a number of radially arranged and rigidly interconnected cantilever beams; training devices, each mounted on one of said radially arranged cantilever beams; an indicator of team actions' efficiency, mounted on said rigid supporting structure, visualizing the team's work quality: the velocity and the amplitude of participants' movements, and the coordination of team members' actions.

18 Claims, 6 Drawing Sheets

TRAINING DEVICE ASSEMBLY FOR GROUP EXERCISES, GAMES AND TEAM CONTESTS

FIELD OF THE INVENTION

The present invention relates to body exercisers and, more particularly, to the methods and means for group exercises on a training device which permits complex body motions. The purpose of the present invention is to enable the users of this equipment to accelerate the development of the following qualities: physical activity; strength and adroitness; ability to perform coordinated team actions; proper reactions of the muscles and vestibular system to complex body motions.

BACKGROUND OF THE INVENTION

The prior art devices known to the applicant and relevant to the present invention can be divided into four groups:

(1) Multifunctional (multipurpose) exerciser like one disclosed in U.S. Pat. Nos. 4,813,667; 4,909,504; 5,690,590; 5,711,745; 5,788,608.

(2) Exercise devices mounted on resilient elements, as, for example, in U.S. Pat. Nos. 4,426,076; 5,634,870.

(3) Rowing machines, like those disclosed in U.S. Pat. No. 5,370,593.

(4) Interactive exercise apparatus as disclosed in U.S. Pat. No. 5,690,582, and exercise machines with motivational or performance displays disclosed in U.S.

SUMMARY OF THE INVENTION

A training device assembly described herein is intended to encourage exercising on sports training devices and to improve their efficiency through an emotional stimulation. It can be used for group exercises, games and team contests. The known training devices are intended for individual exercises, the main target being the development of the muscular system. Additionally, exercising on certain types of training devices may contribute to the development of certain useful habits, for example, to improve the sense of balance. However, due to a rather weak emotional component of exercising on these training devices, the latter do not as a rule appeal to children and youngsters.

The aim of this invention is to convert monotonous exercising on training devices into interesting games and exciting team contests, attracting children and youngsters, as well as people of other age groups. A problem to be solved in order to attain the above mentioned aim is to work out a method for the creation of various types of emotion-stimulating training equipment.

For the solution of this problem, certain sports and games training devices are used as components of a whole training device assembly, usable in a plurality of modifications, comprising:

(a) Rigid supporting structure comprising a number of radially arranged and rigidly interconnected with the help of a mounting means cantilever beams, said cantilever beams are plane or frame girders mounted on horizontal plane or with small inclination to horizon so that its periphery ends are somewhat upper relatively of their center ends, said center ends are rigidly interconnected between themselves or are fixed on a middle unit, said middle unit is an cylindrical or polygonal middle part of the construction, all horizontal sections of said polygonal middle unit are regular polygons with side numbers being equal to the number of said cantilever beams, each one of said cantilever beams is fixed to said middle unit side. Said rigidly interconnected cantilever beams may be cross- or star-shaped with three or more beams, in case of a limited space, e.g., in gyms or on privately owned grounds it is expedient to use a simple linear structure formed by two cantilever beams.

(b) Resilient supporting structure comprising at least one prior art resilient element of the construction selected from the group consisting of:

a steel spring,
a pneumatic.
a rubber block,
a block from resilient synthetic material,
an inflated resilient air chamber,
a float partially sunk into water expanse, the upper end of said resilient elements is attached with the help of said mounting means to said rigid supporting structure and the lower end of said resilient element is installed on the ground surface or on the floor surface or attached to a lower rigid supporting structure comprising lower cantilever beams said lower cantilever beams are plane or frame girders mounted on horizontal plane or with small inclination to horizon so that periphery ends of said cantilever beams are somewhat lower relatively of their center ends, said center ends are rigidly interconnected between themselves or are fixed on a lower middle unit, said lower middle unit is a cylindrical or polygonalmiddle part of said lower rigid supporting structure, all horizontal sections of said polygonal lower middle unit are regular polygons with side numbers being equal to the number of the lower cantilever beams. Said resilient supporting structure ensures possibility of the tilts of said rigid supporting structure in arbitrary direction.

(c) sports and games training devices, each one mounted on one of said radially arranged cantilever beams which permits the users to tilt said rigid supporting structure on said resilient supporting structure, each said sports and games training device may be prior art training device and/or any modification of any prior art training device, for example, a training device, which permits the users to shift their body's center of gravity and/or training device parts along, said cantilever beams; a modification of such training device is a modification of a "race-rowing" training device (see section "Brief description of several variants of training device assemblies").

(d) an efficiency indicator of user's team actions mounted on said rigid supporting structure, said efficiency indicator comprising:

an axle, mounted on said middle unit normally to its upper surface,
a bearing, fixed on the upper end of said axle,
a flag, said flag is a little bar attached to the outer ring of said bearing.
an unbalanced mass, fixed on a periphery end of said flag.

The sequence of coordinated users' team actions with the use of said training device, which permits the users to shift their body's center of gravity and/or training device parts along said cantilever beams is as follows:

(i) With a start signal the first team member shifts the center of gravity of his/her body and/or training device parts at most to the periphery, causing the rigid supporting structure's tilt on the supporting resilient elements towards him;

(ii) The second team member, seated to the left/right from the first one, repeats his/her actions with a certain delay, while the first team member starts shifting his/her body's center of gravity and/or training device parts towards the center of the rigid supporting structure, thus causing its tilt to the second member's side;

(iii) Each team member repeats the actions of a previous member in a circular sequence with a certain delay in time, thus causing periodic tilts of the rigid supporting structure on the supporting resilient elements, which form oscillating tilts with a phase changing from one cantilever beam to another in a circular sequence—a "circular wave" of said rigid supporting structure tilt. The angular velocity of the "circular wave" depends on the velocity and the amplitude of participants' movements, and on the coordination of the team members' actions mentioned in (i), (ii) and (iii). A more detailed description of the sequence of coordinated team actions and the resulting "circular wave" movements is presented in the section "Brief description of the method of employment of training device assembly for group exercises, games and team contests".

The advantageous effects of the invention with reference to the background art are as follows:

1. Training devices for exercising and playing are being currently employed, that can emotionally stimulate physical activities of a user by means of electronic equipment which displays the changing pattern of actions on a monitor mounted in front of the user. Such systems have the following disadvantages: high costs; they cannot be easily employed by children, especially outdoors, due to a high possibility of damaging the electronic system and a high voltage danger; they do not improve coordinated team actions.

In contrast to the above-mentioned devices, training device assemblies provide a possibility to perform coordinated team actions, and various simple, reliable and safe mechanical indicators of the team actions' efficiency can be employed as emotional stimulators of the physical activity in games, thus enabling to perform team contests. The fact that no electro-technical or electronic elements are used in mechanical indicators makes them especially suitable for children and for installation outdoors.

2. Mechanical spring-loaded devices for playing are known. They have the following disadvantages: they cannot develop strength and adroitness as efficiently as training devices; coordinated team actions cannot be improved sufficiently; they lack construction elements for stimulating coordinated group actions and team contests.

Disadvantages mentioned above are overcome in the present invention by the following:

(a) the sport and games training device provides accelerated development of strength and adroitness:

(b) an efficiency indicator of team actions provides a possibility for coordinated team actions;

(c) the efficiency of coordinated team actions is determined by the angular velocity of said "circular wave", that depends both on the velocity and amplitude of motions of Therefore, exercises on training device assemblies contribute to the accelerated development of both strength and adroitness, as well as the ability to perform coordinated team actions; it promotes not only physical, but also intellectual development, helps to overcome hypertrophied individualism and to develop habits of psychological compatibility and friendly relationship in groups;

(d) during a "circular wave" movement of the training device assembly, in addition to the motions with the training device, the users also have to perform secondary motions with the rigid structure: up-and-down movements, as well as back-and-forth and left-right tilts. This contributes to the development of proper reactions of muscles and vestibular system to complex three-dimensional corporal motions.

BRIEF DESCRIPTION OF THE DRAWINGS

To avoid the overload all drawings show only a part of the picture sufficient for the understanding of the structure.

FIG. 7 shows modifications of the simple scheme of an efficiency indicator of coordinated team actions:

DESCRIPTION OF THE PREFERRED EMBODIMENTS

Brief Description of Several Variants of Training Device Assemblies

Figure 1A:
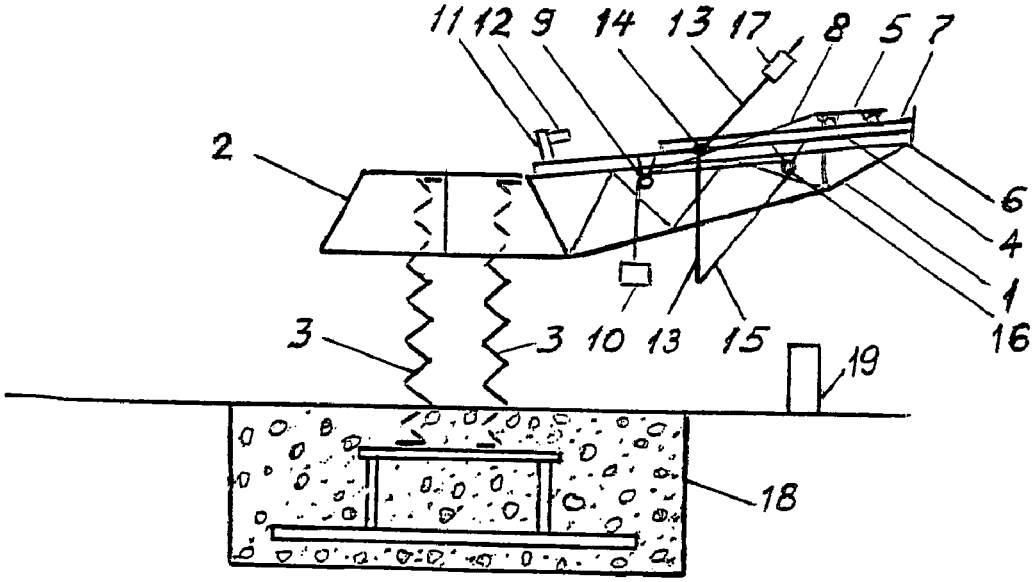
FIG. 1*a* is a side view of a modification of any prior art training device assembly comprising three training "race-rowing" type devices mounted on three radially arranged supporting cantilever beams fixed on three springs concreted into the ground.
Figure 1B:
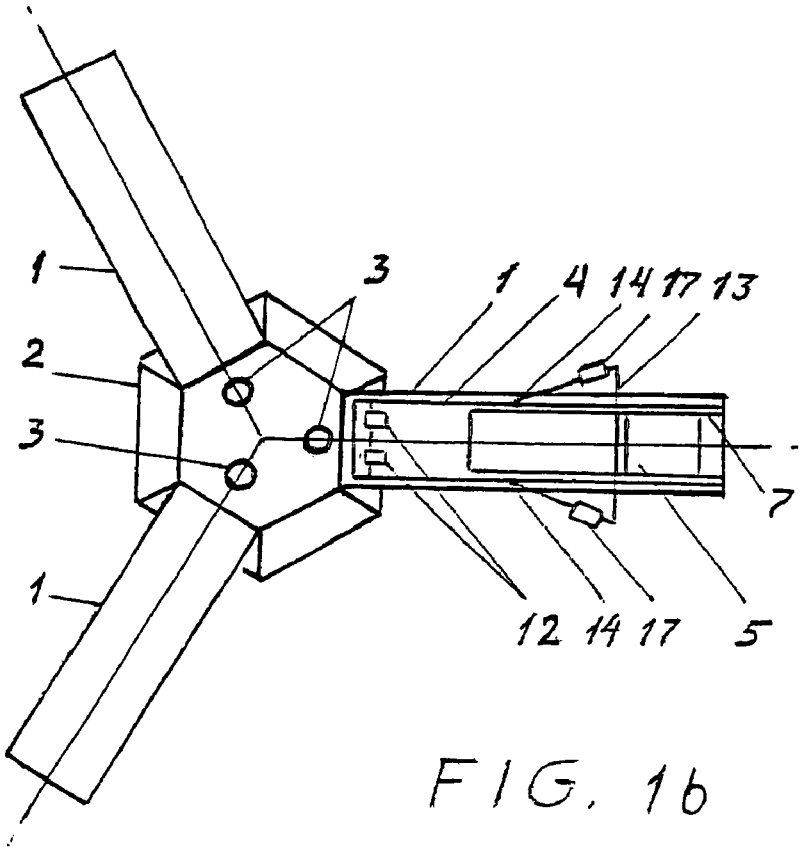
FIG. 1*b* is a plan of said training device assembly.
Figure 1C:
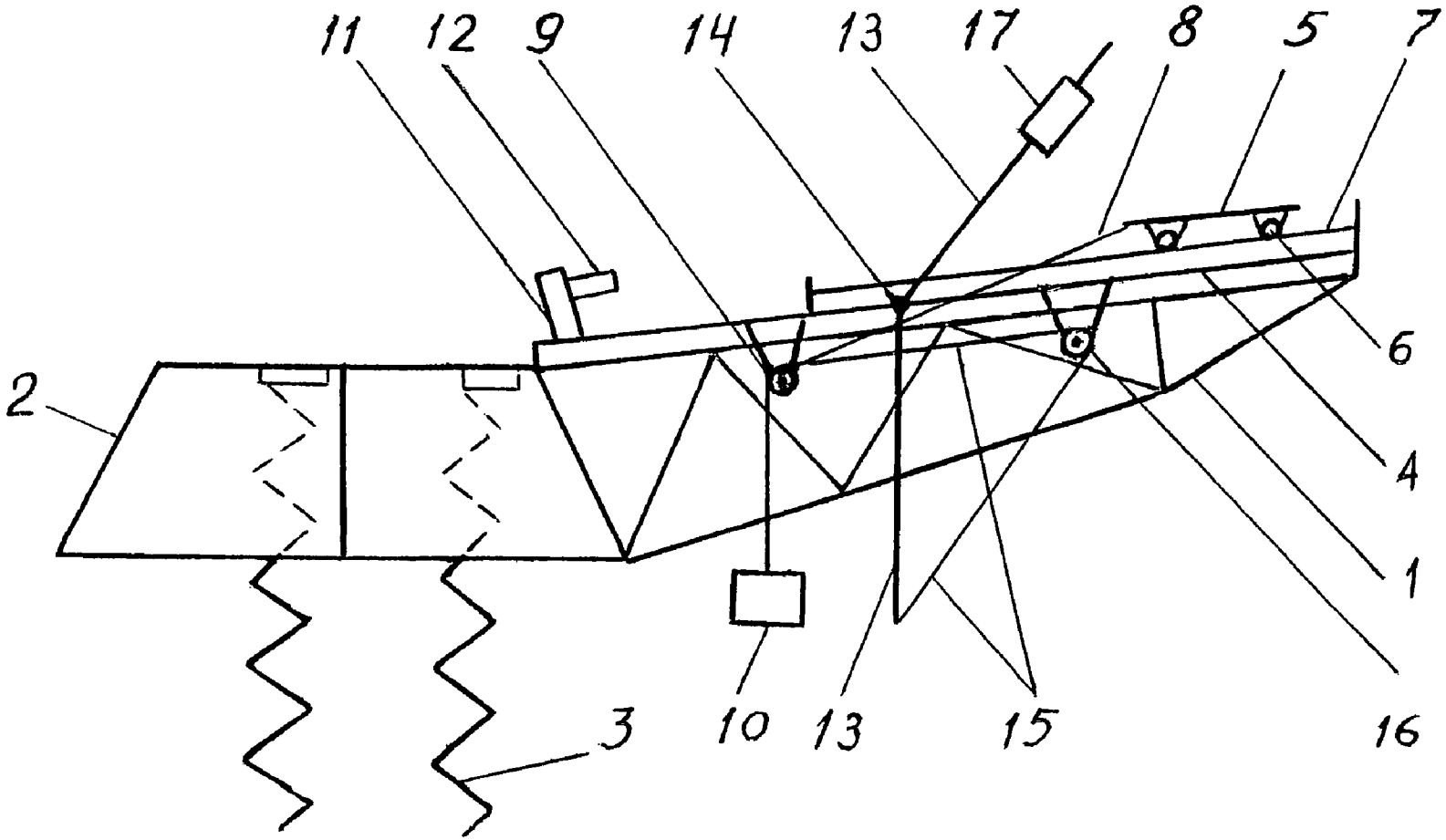
FIG. 1*c* shows any modification of prior art training device of "race-rowing" type mounted on a cantilever beam.
Figure 2A:
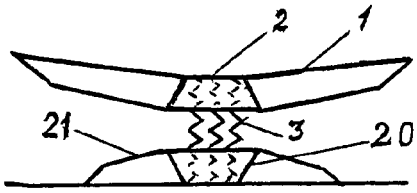
FIG. 2*a* is a side view of a training device assembly for indoors installation.
Figure 3A:
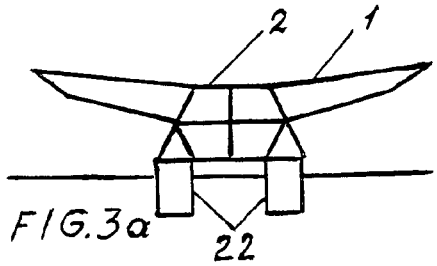
FIG. 3*a* is a side view of a training device assembly with six cantilever beams fixed on the floats, when used on the sea, on the lake etc.
Figure 2B:
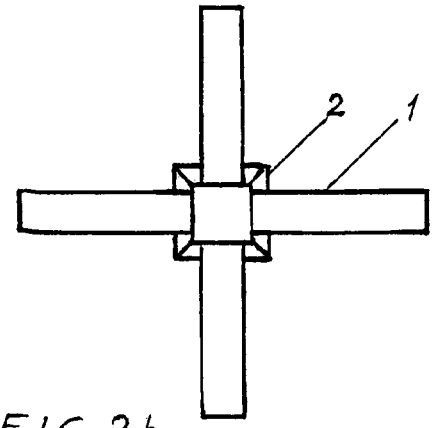
FIG. 2*b* is a plan of the training device assembly shown on FIG. 2*a*.
Figure 3B:
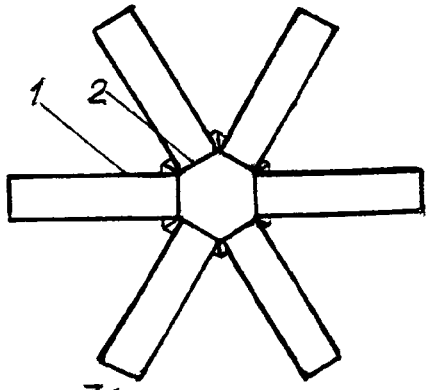
FIG. 3*b* is a plan of the training device assembly shown on FIG. 3*a*.

These training device assemblies may comprise two (due to its simplicity the figure is not presented), three (FIG. 1, a, b, four (FIG. 2, a, b), five, six (FIG. 3, a, b) and more radially arranged cantilever beams (1), rigidly fixed to the middle unit (2), mounted on supporting springs (3), as on FIGS. 1*a* and 2*a*, or on floats (22) when used on the sea, the lake, etc., as on FIG. 3*a*. Frame structures (4) of any modification of prior art "race-rowing" type training device are mounted on cantilever beams, as on FIG. 1, a, b and c. Any modification of prior art "race-rowing" type of training device consists of a seat (5), moving on rollers (6) along the slides (7); a cable (8) connected to the seat or to a belt fastened on a user's waist and passing on a roller (9) to a set of weights (10), or to a spring, or to a hydraulic (pneumatic) force-resistor; a foot support (11) with foot fixing straps (12) fixed in several points along the frame structure (4); a curved bow (13) for arm training, connected to the frame (4) by means of hinges (14), which are fixed at the point of curvature of the bow (13), a cable (15), connected with the bow and running through a roller (16) to the set of weights (10) or to the spring, or to the hydraulic (pneumatic) force-resistor, and carrying its own set of weights (17). An additional set of weights can be also attached to the seat (5). The upper ends of the springs (3) are fixed to the middle unit (2) and the lower ends of said springs can be concreted into the ground (18), as shown on FIG. 1*a*, or fixed to the lower middle unit (20), as shown on FIG. 2*a*, to which lower cantilever beams (21) are attached (this assembly can be used indoors). Floats (22) partially sunk into water can be used instead of supporting springs, as shown on FIG. 3*a*.

An efficiency indicator of team actions is mounted on said rigid supporting structure. There are various types and designs of said indicators (See section "Efficiency indicator"). It is most expedient to use safe, simple and visual mechanical indicators that do not comprise electronic or electro-technical elements.

Brief Description of the Method of Employment of Training Device Assembly for Group Exercises, Games and Team Contests with the Use Said Training Device, which Permits the Users to Shift their Body's Center of Gravity and/or Training Device Parts Along said Cantilever Beams The mode of users' actions on different training devices and on training device with said rigid supporting structure, having a different number of cantilever beams, is basically the same. To illustrate basic features of the offered devices, a mode of actions with three "race-rowing" type training devices with three cantilever beams (a), (b), (c), FIG. 1*a, b, c* will be considered. Users seated on cantilever beams (a), (b), (c) will be lettered with "a", "b", "c", respectively. As a result of a possible non-simultaneous seating, an excessive tilt of the rigid structure may occur. To avoid it, resilient shock-absorber (19) can be used, as shown on FIG 1*a*.

Initial position: "a", "b", "c" fasten the straps on their feet and bend the knees. A referee gives a start signal.

Figure 4A:
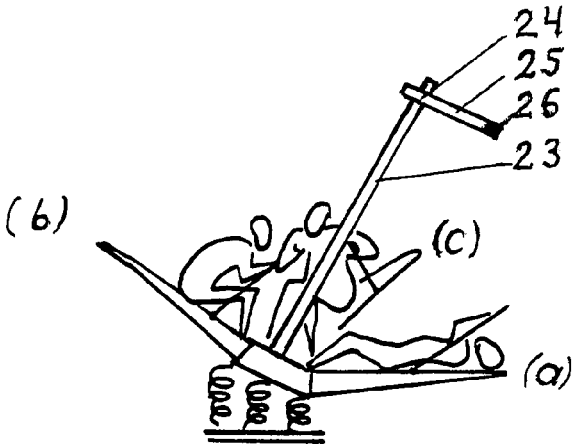
FIG. 4*a* illustrates one of the phases of coordinated team actions and a corresponding to this phase position of the simple form of the efficiency indicator.
Figure 4B:
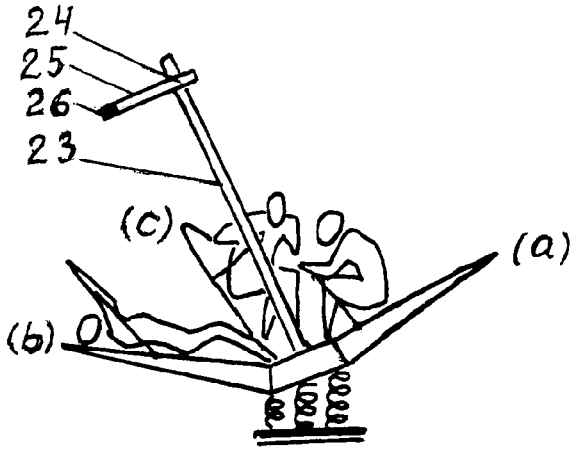
FIG. 4*b* illustrates the next phase of coordinated team actions and a corresponding to this next phase position of the simple form of the efficiency indicator.

Phase 1: "a" straightens his/her legs, moves the body back and pulls the bow (13) towards him/herself with his/her hands to facilitate the legs work; "b" and "c" move their bodies forward by pushing away the bow (13) and bending the arms. The shift of the center of gravity results in the lowering of the periphery end of the cantilever beam (a) and the rising of the cantilever beams (b) and (c), as shown on FIG. 4,*a*.

Phase 2: "b" repeats the actions of "a" in Phase 1, "a" bends his/her knees and repeats the actions of "b" and "c" in Phase 1. The periphery end of the cantilever beam (b) lowers, that of the cantilever beam (a) rises, while the periphery end of the cantilever beam (c) remains elevated, as shown on FIG. 4, *b*.

Phase 3: "c" repeats the actions of "b" in Phase 2, "b" repeats the actions of "a" in Phase 2. A periphery end of the cantilever beam (c) lowers, that of the cantilever beam (b) rises, while the periphery end of the cantilever beam (a) remains elevated.

Thus, the cycle is completed, whereupon it is numerously repeated in the same circular mode of users' actions. After the completion of the preset number of cycles, a referee registers the time shown by the team. In a more complex program, the contest is resumed, but motions in each cycle are performed in a reverse order: first, "c" repeats the actions of "a", then "b" repeats the actions of "a". These "reverse" cycles are repeated till the final call of the referee.

To avoid an excessive backward incline of the users' bodies in the downward movement of the periphery end of the cantilever beams, when their heads may sink below their legs, the cantilever beams (1) are fastened to the middle unit (2) at an angle to the horizon, as shown on FIGS. 1*a*, 2*a*, 3*a*. This also creates an additional resistance in legs straightening. The above mentioned users' coordinated alternating motions back-and-forth along the axis of the training device cause periodic tilts of the cantilever beams on the supporting resilient elements in a circular mode, while the periphery ends of these beams perform oscillating up-and-down motions. The phase of these oscillations changes from one cantilever beam to the next in a circular sequence in which every next cantilever beam repeats the oscillations of the previous one with a certain phase lag in time, thus creating a "circular wave" of said rigid supporting structure tilt similar to ordinary sea waves, which may also be caused by gravitation (the difference is that their motions are not circular, but rather progressive).

Complex periodic motions performed by users may be subdivided into main and secondary ones. Users' main motions on the training device are performed with a resistance depending on the combination of weights or adjustable spring tension, and on the adjusting of hydraulic or pneumatic force-resistors. (It is possible to use training device, where users shift the training device parts while seating or standing on the fixed elements). Users' main motions are: bending and straightening the legs at the knees; bending and straightening the body in the waist; motions of arms and shoulders; forward and backward motions of the head. Users' secondary motions are performed together with the rigid structure: up-and-down motions accompanying back-and-forth and left-and-right tilts. Users' secondary motions are no less emotionally stimulating than riding on a "merry-go-round", while they are safer, as the structure elements do not rotate.

Efficiency Indicator

Figure 5:
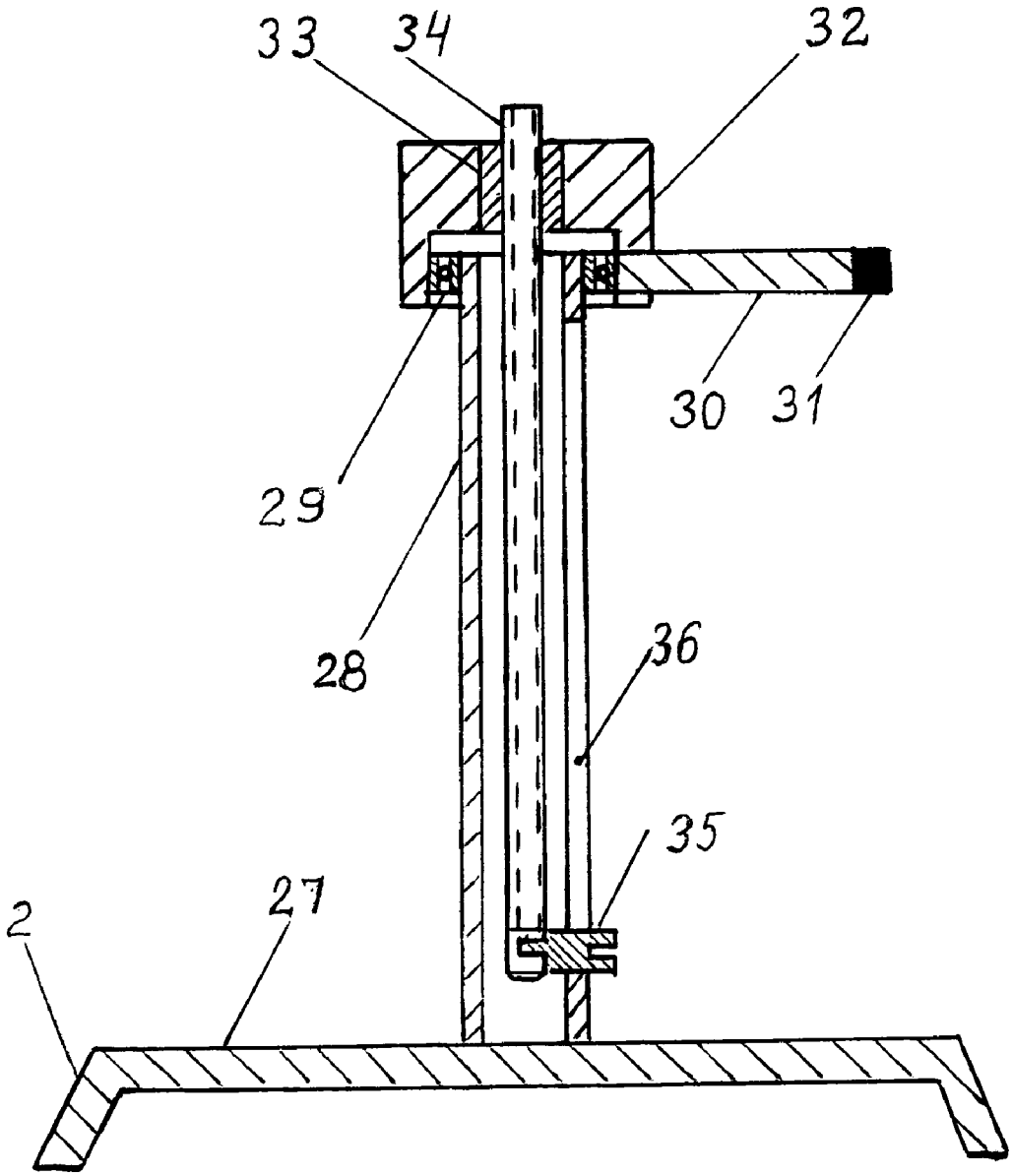
FIG. 5 is an elevation of one of the types of a mechanical efficiency indicator of coordinated team actions.

An embodiment of a visual mechanical indicator of the "circular wave" angular speed is presented on FIG. 5. A middle unit (2) holds a pipe (28) mounted normally to its upper surface (27) with a bearing (29) on its upper end. On the outer ring of the bearing a flag (30) is fixed with an unbalanced mass (31) attached to its free end. A holder (32) with a nut (33) is additionally fixed on the outer ring of the bearing (29). A stud (34) is screwed into the nut (33). On the lower part of the stud (34) a short pin (35) is fixed, which passes into a slot (36) in the pipe (28), thus preventing the stud (34) from rotation.

When the rigid structure moves in a "circular wave" mode the pipe (28) circumscribes a cone-like surface and said unbalanced mass causes the turn of the flag in the direction of the tilt. As a result the flag (30) rotates around the pipe (28) with the angular speed of the "circular wave". Together with the flag the holder (32) and the nut (33) are rotating. The nut (33) moves the stud (34) up or down depending on the direction of rotation. The stud's linear speed is proportional to the angular speed of the flag and that of the "circular wave", and this motion of the stud is visualized with the help of colored marks applied on its surface; as soon as said short pin (35) moves to the end of the slot (36) in the pipe (28), the flag's rotation discontinues, which may serve as a finish signal or a signal for team members to act in the reverse circular sequence thus enabling the "circular wave" and the flag to rotate in the opposite direction.

Figure 6:
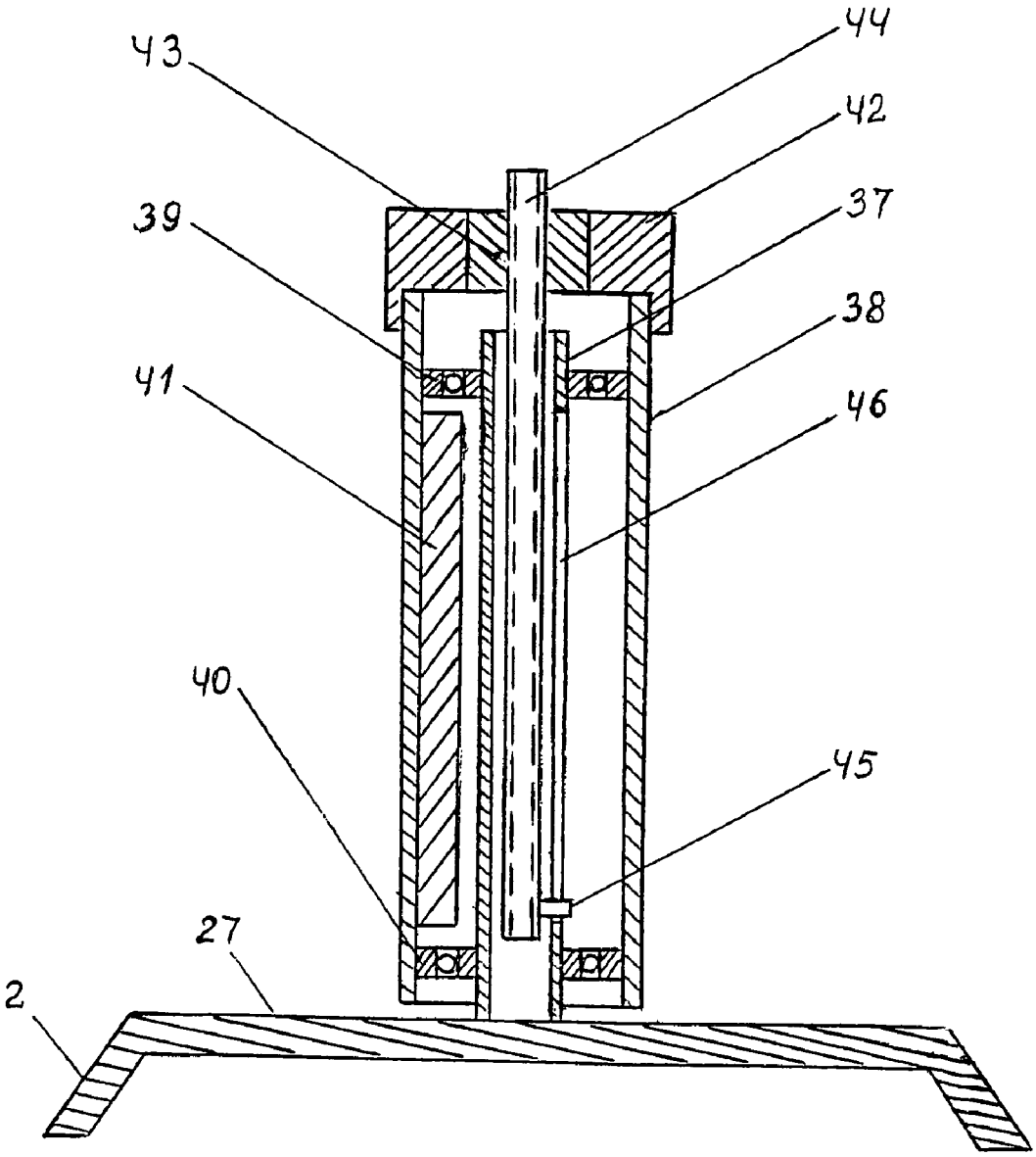
FIG. 6 is an elevation of an efficiency indicator of coordinated team actions with two coaxial pipes, where the outer pipe is a protective cover of an unbalanced mass.

A more complex efficiency indicator design is shown on FIG. 6 comprising:

an inner pipe (37), mounted on the middle unit (2) normally to its upper surface (27);

an outer pipe (38) coaxial with the inner pipe (37);

two bearings (39) and (40) connecting the inner pipe (37) and the outer pipe (38) next to the upper and lower ends of said pipes;

an unbalanced mass (41) attached to the inner surface of the outer pipe (38);

a holder (42), attached to the upper end of the outer pipe (38);

a nut (43), attached to the holder (42);

a stud (44), screwed into the nut (43);

a short pin (45), attached to the lower end of the stud (44);

a vertical slot (46) in the inner pipe (37), into which enters the short pin (45) thus preventing the stud (44) from rotation;

colored marks, attached to the upper end of the stud (44).

In the constructive schemes, shown on FIG. 5 and FIG. 6, ball-bearings are used. It's also possible to use the more simple plain bearings. On the scheme shown on FIG. 4 the simplest plain bearing is used, comprising the hole close to the end of the beam (25) and an axle (23), passing through this hole. So, in this construction the "bearing" is not one detail, but belongs partially to an axle (23), and partially to the beam (25)—and for this reason is not capable of and doesn't need visual or labeled representation. Furthermore, due to the extreme simplicity of such "bearing" it doesn't need an illustration. But the turn of the flag on 180 degrees from the assembly position, shown on FIG. 4, a to its position, shown on FIG. 4, b, unambiguously shows the possibility of the flag to turn around the axle, which is impossible without any "bearing". In simple efficiency indicators' constructions it's enough to mark out only the place of such "bearing" on a drawing. Such efficiency indicator is used in the training device assembly shown on FIG. 4*a*, b, comprising: cantilever beams (1); a middle unit (2); steel springs (3); an axle (23), mounted on the middle unit (2) normally to its upper surface and passing through the hole in a flag (25), thus forming a "bearing" in a place marked (24); an unbalanced mass (26), fixed on the free end of said flag.

Figure 7A:
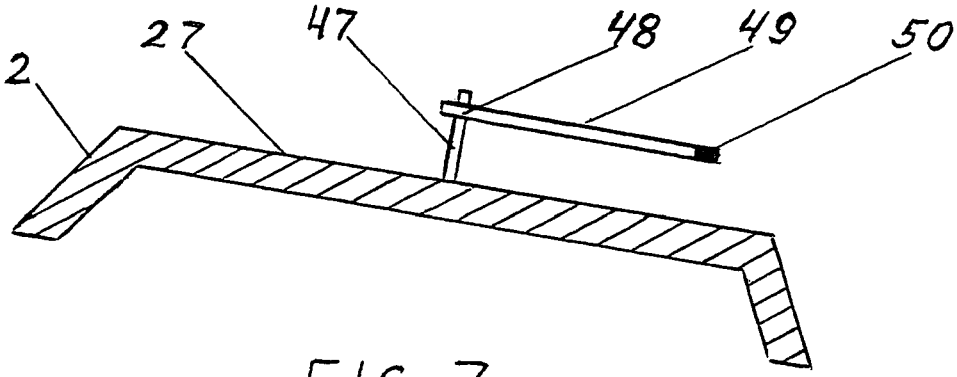
FIG. 7*a* shows a low position of said flag.

Another simple efficiency indicator is shown on FIG. 7*a*, comprising: a short axle (47), mounted on the middle unit (2) normally to its upper surface (27) and passing through the hole in a flag (49) thus forming a "bearing" in a place (48); an unbalanced mass (50), fixed on the free end of said flag.

Figure 7B:
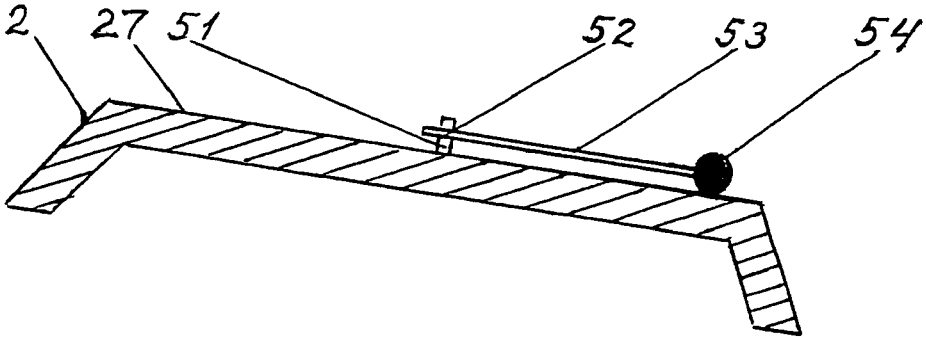
FIG. 7*b* shows an efficiency indicator with a ball attached to the beam or to the cable.

Another simple efficiency indicator is shown on FIG. 7*b*, comprising: a short axle (51), mounted on the middle unit (2) normally to its upper surface (27) and passing through the hole in a flag (53) thus forming a "bearing" in a place (52); a ball (54), attached to the free end of a beam (53) (or of the cable) and rolling over the periphery of the upper surface (27) of the middle unit (2).

Some toys can be hanged on the flag if the assembly is used by children, so that when the flag is rotating, there is a roundabout of toys.

In case if a linear supporting structure is formed by two cantilever beams the "circular wave" does not appear, however said indicators of the team actions efficiency can by used. For this purpose one of the users should launch the rotating impulse with his/her hand to the rotating element of said indicator, and then both users should act to originate the tilts of rigid supporting structures being synchronized with the rotation.

In order to enable young children of pre-school age to develop skills of coordinated team actions, seats are mounted on the periphery ends of the cantilever beams, so that the children, while seated on said seats, can push off with their feet from the ground in a circular sequence, and the resulting coordinated motions produce a "circular wave".

In order to enable users to exercise on said training device assembly standing on the outer ends of said cantilever beams, foot supporting means is used, said foot supporting means consists of a prior art planks with a handles mounted on periphery ends of said cantilever beams. The mode of team member actions is as follows:

(1) all team members are standing on said planks and hold on to said handles, (2) one of said team members, let's define him the first team member, standing on said cantilever beam, let's define it the first cantilever beam, straightens out actively his/her legs and moves back his/her body, and the team member standing on the cantilever beam opposite to the first cantilever beam bends his/her legs and moves forward his/her body, which results in tilt of said rigid supporting structure in the direction to said first cantilever beam, (3) the others team members repeat one after another, in a circular sequence, the actions of said first and said opposite to the first team members with a certain delay in time, which results in the rotation of said rigid supporting structure tilts in the same circular sequence and the rotation of said flag is synchronous with said tilt rotation under the action of said unbalanced mass fixed on its periphery end; and the bigger the activity of the team members' movements and the greater the coordination in a circular sequence of their team actions, the higher its angular velocity, and angular velocity of said flag is the efficiency indication of the team members actions.

What is claimed is:

1. A training device assembly, comprising:

(a) Rigid supporting structure comprising a number of radially arranged and rigidly interconnected with the help of a mounting means cantilever beams, said cantilever beams are plane or frame girders mounted on horizontal plane or with small inclination to horizon so that its periphery ends are somewhat upper relatively of their center ends, said center ends are rigidly interconnected between themselves or are fixed on a middle unit, said middle unit is an cylindrical or polygonal middle part of the construction, all horizontal sections of said polygonal middle unit are regular polygons with side numbers being equal to the number of said cantilever beams, each one of said cantilever beams is fixed to said middle unit side, said rigidly interconnected cantilever beams may be cross- or star-shaped with three or more beams, in case of a limited space it is expedient to use a simple linear structure formed by two cantilever beams;

(b) Resilient supporting structure comprising at least one prior art resilient element of the construction selected from the group consisting of:

a steel spring, a pneumatic, a rubber block, a block from resilient synthetic material, an inflated resilient air chamber, a float partially sunk into water expanse, the upper end of said resilient elements is attached with the help of said mounting means to said rigid supporting structure and the lower end of said resilient element is installed on the ground surface or on the floor surface or attached to a lower rigid supporting structure comprising lower cantilever beams, said lower cantilever beams are plane or frame girders mounted on horizontal plane or with small inclination to horizon so that periphery ends of said cantilever beams are somewhat lower relatively of their center ends, said center ends are rigidly interconnected between themselves or are fixed on a lower middle unit, said lower middle unit is a cylindrical or polygonal middle part of said lower rigid supporting structure, all horizontal sections of said polygonal lower middle unit are regular polygons with side numbers being equal to the number of the lower cantilever beams, said resilient supporting structure ensures possibility of the tilts of said rigid supporting structure in arbitrary direction, (c) sports and games training devices, each one mounted on one of said radially arranged cantilever beams, which permits the users to tilt said rigid supporting structure on said resilient supporting structure, each said sports and games training device may be prior art training device and/or any modification of any prior art training device, for example, a training device, which permits the users to shift their body's center of gravity and/or training device parts along said cantilever beams, a modification of such training device is a modification of a "race-rowing" training device, comprising:

a frame structure mounted on a cantilever beam, slides mounted on said frame structure, a seat, moving on rollers along said slides, a cable connected to a seat or to a belt attached to a user's waist and passing on a roller to a set of weights, or to a spring, or to a hydraulic (pneumatic) force-resistor, a foot support with foot fixing straps secured in several points along said frame structure, a bow for arm training, connected to said frame structure by means of hinges, a cable connected to said bow, running through a roller to said set of weights, or to said spring, or to said hydraulic (pneumatic) force-resistor, an additional set of weights attached to the seat;

(d) an efficiency indicator of user's team actions mounted on the said rigid supporting structure, said efficiency indicator comprising:

an axle, mounted on said middle unit normally to its upper surface, a bearing, fixed on the upper end of said axle, a flag, said flag is a little bar attached to the outer ring of said bearing, an unbalanced mass, fixed on a periphery end of said flag.

2. A training device assembly of claim 1, wherein said prior art resilient supporting element of the construction is steel spring, the upper end of said steel spring is attached with the help of said mounting means to said rigid supporting structure and the lower end of said steel spring is fixed in the ground surface or is attached to the lower rigid supporting structure, comprising said lower cantilever beams and said lower middle unit.

3. A training device assembly of claim 1, wherein said resilient supporting element of the construction is prior art pneumatic, the upper end of said pneumatic is attached with the help of said mounting means to said rigid supporting structure and the lower end of said pneumatic is fixed on the ground surface or is attached to said lower rigid supporting structure.

4. A training device assembly of claim 1, wherein said prior art resilient supporting element of the constructions is a rubber block or a block of a resilient synthetic material, said rubber block or a block of a resilient synthetic material is vertically positioned cylinder or prism with a protection cover of a dense waterproof cloth, the upper end of said rubber block or block of said resilient synthetic material is attached with the help of said mounting means to said rigid supporting structure and the lower end of said block is installed on the ground surface or on the floor surface or is attached to said lower rigid supporting structure.

5. A training device assembly of claim 1, wherein said prior art resilient supporting element of the construction is inflated resilient air chamber, for example, an inner rubber tube of a tire or a basketball with a protection cover of a dense waterproof cloth, attached with the help of said mounting means to said rigid supporting structure and installed on the ground surface or on the floor surface or attached to said lower rigid supporting structure.

6. A training device assembly of claim 1, wherein said supporting element of the construction is prior art float, said float can be wood, steel or plastic cylinder, cone or sphere, the upper end of said float is attached with the help of said mounting means to said rigid supporting structure and said float is partially sunk into water expanse.

7. A training device assembly of claim 1, wherein said rigid supporting structure is a linear structure formed by two cantilever beams.

8. A training device assembly of claim 1, wherein said rigidly interconnected cantilever beams are star-shaped with three or more beams.

9. The method of group exercises, games and team contests with the use a training device assembly of claim 1, wherein the team members use said sports and games training devices which permit the users to tilt said rigid supporting structure on said resilient supporting structure and the team members specifically use said training devices, which permits the users to shift their body's center of gravity and/or training device parts along said cantilever beams; each team member repeats one after another his/her left/right neighbor's actions in a circular sequence with a certain delay in time, which results in periodic shifts of the gravity center of the complete system, consisting of said rigid supporting structure, all said team members and all said training devices, and corresponding tilts rotation of said rigid supporting structure in the same circular sequence and rotation of said flag synchrony with said tilt rotation under action of said unbalanced mass fixed on its periphery end, said tilt rotation is a "circular wave" of the tilts; and the faster shifts said complete gravity center and consequently the greater the velocity and the amplitude of team member's movements and the coordination in a circular sequence of their team action, the greater "circular wave" of the tilts' angular velocity and therefore said angular velocity of said "circular wave" and said flag is the efficient indication of the team member's actions.

10. An efficiency indicator of users' team actions of claim 1 comprising:

a pipe, mounted on said middle unit normally to its upper surface;

a bearing, put on the upper end of said pipe;

a flag, said flag is a little bar attached to the outer ring of said bearing;

an unbalanced mass, attached to the periphery end of said flag;

a holder, attached to the outer ring of said bearing;

a nut, attached to said holder;

a stud, screwed into said nut;

a short pin, attached to the lower end of said stud;

a vertical slot in said pipe, into which enters said short pin thus preventing the stud from rotation;

colored marks, attached to the upper end of said stud.

11. An efficiency indicator of users' team actions of claim 10, wherein a more complex design of the efficiency indicator is used comprising:

an inner pipe, mounted on said middle unit normally to its upper surface;

an outer pipe coaxial with said inner pipe;

two bearings connecting said inner pipe and said outer pipe next to the upper and lower ends of said pipes;

an unbalanced mass attached to the inner surface of said outer pipe;

a holder, attached to the upper end of said outer pipe;

a nut, attached to said holder;

a stud, screwed into said nut;

a short pin, attached to the lower end of said stud;

a vertical slot in said inner pipe, into which enters said short pin thus preventing the stud from rotation;

colored marks, attached to the upper end of said stud.

12. A training device assembly of claim 1, comprising simple sports and games training devices which consist of prior art seats with handles mounted on the periphery ends of said cantilever beams, so that the users can push off with their feet from the ground surface.

13. A training device assembly of claim 12, wherein some toys are hanged on the flag, so that when the flag is rotating there is a roundabout of toys.

14. A training device assembly of claim 12, wherein its small sizes allow its usage as a table game.

15. A training device assembly of claim 1, wherein a simple efficiency indicator is used comprising:

an axle, mounted on said middle unit normally to its upper surface;

a bearing, put on said axle;

a little cantilever bar or a cable, attached to the outer ring of said bearing;

a ball attached to the periphery end of said cantilever little bar or to said cable and rolling over the periphery of the upper surface of said middle unit.

16. A training device assembly of claim 1, comprising simple sports and games training devices being foot supporting means, said foot supporting means consists of a prior art planks with handles mounted on the periphery ends of said cantilever beams, said planks allow the users to stand on said plank surface.

17. The method of group exercises, games and team contests with the use of a training device assembly of claim 12, wherein the team members use said seats with handles, mounted on the periphery ends of said cantilever beams and the mode of their team actions is as follows:

(1) all team members seat on said seats and hold on to said handles;

(2) one of said team members, let's define him the first team member, seating on said cantilever beam, let's define it the first cantilever beam, pushes off with his/her feet from the ground surface or from the floor surface and bends forward his/her body, and the team member seating on the opposite cantilever beam bends his/her feet and bends over his/her body, which results in the tilt of said rigid supporting structure in the direction opposite to said first cantilever beam;

(3) the other team members repeat one after another, in a circular sequence, actions of said first and said opposite to the first team members with a certain delay in time, which results in the rotation of said rigid supporting structure tilt in the same circular sequence, and rotation of said flag is synchronous with said tilt rotation under action of said unbalanced mass fixed on its periphery end: and the bigger the activity of the team members' movements and the greater the coordination in a circular sequence of their team actions, the higher its angular velocity, and angular velocity of said flag is the efficiency indication of the team members actions.

18. The method of group exercises, games and team contests with the use of a training device assembly of claim 16, wherein the team members use said planks with said handles mounted on the periphery ends of said cantilever beams, and the mode of their team actions is as follows:

(1) all team members stand on said planks and hold to said handles:

(2) one of said team members, let's define him the first team member, standing on said cantilever beam, let's define it the first cantilever beam, straightens out actively his/her legs and moves back his/her body, and the team member standing on the cantilever beam opposite to the first cantilever beam bends his/her legs and moves forward his/her body, which results in the tilt of said rigid supporting structure in the direction to said first cantilever beam:

(3) others team members repeat one after another in a circular sequence actions of said first and said opposite to the first team members with a certain delay in time, which results in the rotation of said rigid supporting structure tilts in the same circular sequence and rotation of said flag synchrony with said tilt rotation under action of said unbalanced mass fixed on its periphery end; and the bigger the activity of the team members' movements and the greater the coordination in a circular sequence of their team actions the higher its angular velocity and angular velocity of said flag is the efficiency indication of the team members actions.

* * * * *